US005372004A

United States Patent [19]

Yamamoto et al.

[11] Patent Number: 5,372,004

[45] Date of Patent: Dec. 13, 1994

[54] COOLING PLATE OF A TEXTURING MACHINE

[75] Inventors: Shigeru Yamamoto; Shunzo Naito, both of Matsuyama, Japan

[73] Assignee: Teijin Seiki Co., Ltd., Osaka, Japan

[21] Appl. No.: 67,066

[22] Filed: May 26, 1993

[30] Foreign Application Priority Data

May 27, 1992 [JP] Japan ..... 4-160360

[51] Int. Cl.[5] ..... D02G 3/02; D02G 1/00

[52] U.S. Cl. ..... 57/290; 28/247; 28/249; 57/284; 57/351; 57/352; 57/354

[58] Field of Search ..... 28/247, 249, 258; 57/290, 284, 286, 292, 308, 352, 352, 354, 355, 356, 357, 351

[56] References Cited

U.S. PATENT DOCUMENTS

| | | | |
|---|---|---|---|
| 3,368,335 | 2/1968 | Horvath | 28/247 X |
| 3,696,601 | 10/1972 | McCarn | 57/34 HS |
| 3,999,360 | 12/1976 | Forin et al. | 57/308 X |
| 4,141,206 | 2/1979 | Eaves | 57/352 X |
| 4,238,921 | 12/1980 | Steck et al. | 57/308 X |
| 4,905,468 | 3/1990 | Tanae et al. | 57/284 X |

FOREIGN PATENT DOCUMENTS

| | | |
|---|---|---|
| 4224118 | 1/1993 | Germany . |
| 60-143783 | 9/1985 | Japan . |
| 3-30275 | 3/1991 | Japan . |
| 1275643 | 5/1972 | United Kingdom . |

*Primary Examiner*—Daniel P. Stodola
*Assistant Examiner*—William Stryjewski
*Attorney, Agent, or Firm*—Rothwell, Figg, Ernst & Kurz

[57] ABSTRACT

A draw texturing machine comprises a first heater for heating a yarn, a false twisting device for imparting twists to the yarn, and a cooling plate, disposed between the first heater and the false twisting device, for cooling the yarn which has been heated by the first heater and for inhibiting vibration of the yarn so as to allow the yarn to run in a stable manner. The cooling plate is provided with a yarn threading groove member having a bottom portion with which the yarn runs in contact and wall portions connected to the bottom portion to form a concave, downwardly directed opening. The wall portions of the yarn threading groove member are provided with a plurality of holes, and the bottom portion of the yarn threading groove member is provided with no holes.

5 Claims, 3 Drawing Sheets

COOLING PLATE OF A TEXTURING MACHINE

BACKGROUND OF THE INVENTION

1. Technical Field of the Invention

The present invention relates to a cooling plate of a texturing machine. More specifically, the present invention relates to a cooling plate disposed in a texturing machine or a draw texturing machine comprising a first heater for heating a yarn, a false twisting device for imparting twists to the yarn, and the cooling plate, disposed between the first heater and the false twisting device, for cooling the yarn which has been heated by the first heater and for inhibiting vibration of the yarn so as to allow the yarn run in a stable manner.

2. Description of Relevant

A supply yarn supplied with a texturing machine or a draw texturing machine is generally applied with finish so as to enhance smooth withdrawal of a yarn from a supply package and its processing. Such finish applied to the yarn is heated in a first heater, and a part of the finish is evaporated to oily smoke which is then transferred by an air flow accompanying the running yarn to the outlet of the first heater, where it is sucked into a suction pipe for removing the oily smoke. Further, a part of the finish is converted to liquid oil which has a high temperature and a low viscosity and which adheres to filaments constituting the yarn. The liquid oil adhering to the filaments may be scattered as it moves with the running yarn and may be condensed at a deflecting guide disposed at the outlet of the heater or at the bottom of the cooling plate with which the yarn runs in contact. Thus, oil drops adhere to the yarn guides or the cooling plate.

In particular, when the first heater and the cooling plate are arranged so that the yarn passage scarcely has very small deflection therebetween (see, for example, the arrangement of the first heater and the first cooling plate in U.S. Pat. No. 4,905,468), the oily smoke and oil drops generated from finish in the first heater are directly transferred to the cooling plate, and thus, scattering, cooling and condensation of finish are caused at the bottom of the cooling plate as described above.

In order to prevent scattering, cooling and condensation of finish from occurring, it may be recommended to dispose a cooling plate which has a groove with which a running yarn is in contact and a plurality of holes at the bottom of the groove so that oil drops adhering to a running yarn are discharged through the holes.

However, if holes are formed at the yarn contacting portion of the groove with which a yarn runs in contact, there is a problem that the cooling ability of the plate is deteriorated since the contacting area between the yarn and the bottom of the groove is decreased due to the existence of the holes. Further, there is another problem that finish applied to the yarn is deposited at the corner of the holes which are formed at the bottom. In addition, the yarn running at the bottom of the groove of the cooling plate is rotated on the cooling plate due to twists imparted by a false twisting device, and thus, there is a further problem that filaments constituting the yarn which is rotating about the corner of the holes formed at the bottom of the groove of the cooling plate and, consequently, the yarn quality is degraded due to the damage of the filaments caused by scratching at the corner of the holes.

Taking into consideration the above-described disadvantages inherent to the conventional devices, it is an object of the present invention to provide a cooling plate of a texturing machine or a draw texturing machine by which the cooling ability of the cooling plate is good since the contacting area between the yarn and the bottom of the groove is not decreased.

It is another object of the present invention to provide a cooling plate of a texturing machine or a draw texturing machine by which the interval between cleaning of the cooling plate can be elongated since finish applied to the yarn is not deposited at the corner of the holes.

SUMMARY OF THE INVENTION

According to the present invention, the above-described objects are achieved by a texturing machine or a draw texturing machine which comprises a first heater for heating a yarn, a false twisting device for imparting twists to the yarn, and a cooling plate disposed between the first heater and the false twisting device for cooling the yarn which has been heated by the first heater and for inhibiting vibration of the yarn so as to allow the yarn to run in a stable manner.

The cooling plate is provided with a yarn threading groove member having a bottom portion with which the yarn runs in contact and wall portions connected to the bottom portion to form a concave, downwardly directly opening.

The wall portions of the yarn threading groove member are provided with a plurality of holes, respectively, while the bottom portion of the yarn threading groove member is free of holes.

According to the present invention, both the wall portions of the yarn threading groove member of the cooling plate are provided with a plurality of holes while no holes are formed at the bottom portion of the groove member. Accordingly, the contacting area between the yarn and the bottom of the groove is not decreased by the holes and, consequently, the cooling ability of the cooling plate is not reduced.

Since according to the present invention, there are no holes at the bottom portion of the groove member with which a yarn is in contact, finish applied to the yarn is not deposited at the corner of any such holes. Further, the yarn quality is not degraded according to the present invention since the yarn is not scratched by any such holes.

Further, according to the present invention, both the wall portions are provided with a plurality of holes, whereby finish scattered at the bottom portion of the cooling plate is discharged to the outside of the cooling plate through the holes. As a result, adhesion of the oil drops to the yarn threading groove member is decreased, and the interval for cleaning the adhered liquid oil can be increased.

The discharge of finish may be carried out by the spontaneous convection of air. However, ends of the wall portions of the cooling plate opposite to the bottom portion may be bent outwardly, respectively, and the ends may be connected to each other at a rear of the yarn threading groove member so as to form a suction chamber, and the suction chamber may communicate with a suction means. Thus, finish separated from the yarn running through the yarn threading groove member may be actively sucked through the holes to the suction chamber. When a suction chamber which actively removes finished is formed, the cleaning interval of the cooling plate can be further elongated.

When a suction chamber is formed as described above, it is preferred that an outlet for discharging the finish be disposed at a lower side of the suction chamber.

The shape of the holes formed on the wall portions of the cooling plate according to the present invention is not limited. However, it is preferred that the holes of the wall portions be elongated in a longitudinal direction of the cooling plate. Further, it is preferred that a plurality of elongated holes be disposed along an imaginary line directed in the longitudinal direction of the cooling plate.

Still further, it is preferred that a plurality of elongated holes be disposed along a plurality of imaginary lines directed in the longitudinal direction of the cooling plate, and that ends of adjacent elongated holes in the plurality of lines overlie each other in a direction along which gravitational forces act.

BRIEF DESCRIPTION OF THE DRAWINGS

The present invention will now be explained in detail with reference to the accompanying drawings, wherein.

PREFERRED EMBODIMENTS

Figure 1:
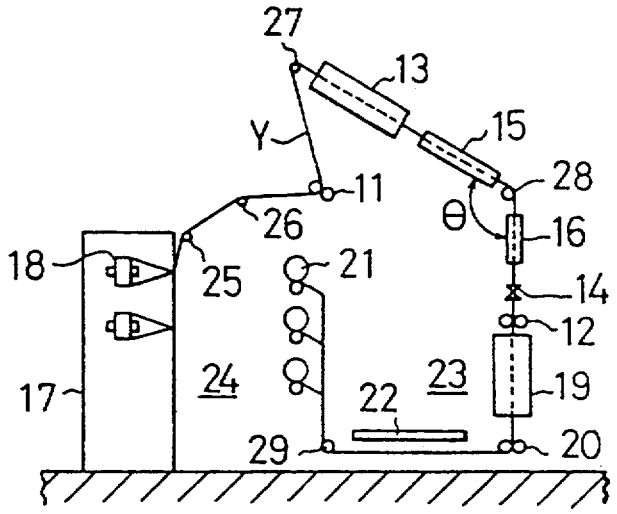
FIG. 1 is an elevation view schematically showing a draw texturing machine according to the present invention.
Figure 2:
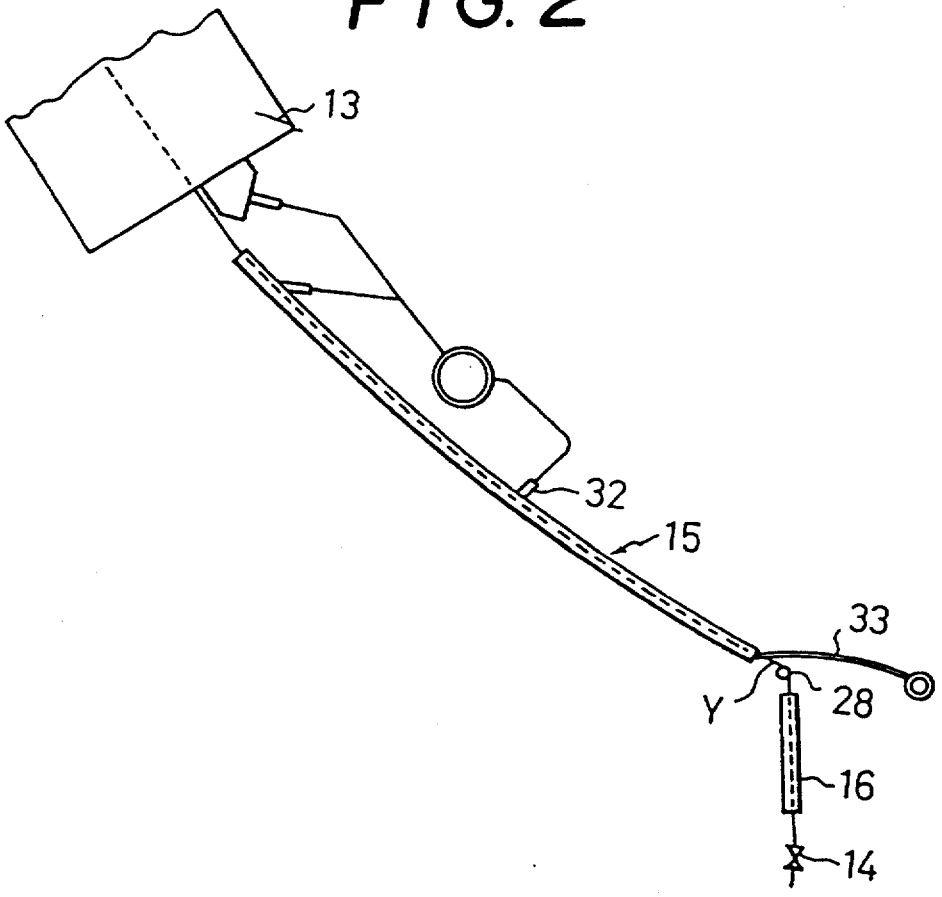
FIG. 2 is an enlarged elevation view showing a cooling plate installed in the draw texturing machine in FIG. 1.

Referring to FIG. 1 which is an elevation view schematically showing a draw texturing machine according to the present invention, a yarn Y, for example, made of a synthetic fiber such as polyester or polyamide, is withdrawn from a supply package 18 supported on a creel 17 and is fed to a first heater 13 through yarn guides 25 and 26, first feed roller device 11 and a yarn guide 27. A first cooling plate 15 of the present invention is disposed downstream from the first heater 13 (see FIG. 2), and a deflecting guide 28 and a second cooling plate 16 are disposed downstream from the first cooling plate 15. A false twisting device 14 is disposed below the second cooling plate 16. The false twisting device is of a well known type, such as a device provided with equidistantly supported multiple spindles and multiple discs mounted on the spindles, or a rotary spindle with a twisting pin. A second feed roller device 12 is disposed beneath the false twisting device 14. A second heater 19 disposed below the second feed roller device 12 adjusts the bulk properties or stretch properties of the yarn Y. Reference numeral 20 denotes a third feed roller device. The yarn Y is guided from the third feed roller device 20 and passes under the threading aisle 22, and then through a guide 29 to a take up 21 where it is wound into a yarn package.

In the machine which has such a construction as described above, while the yarn Y withdrawn from the supply package 18 is drawn at a predetermined draw ratio between the first and second roller devices 11 and 12, twists are imparted to the yarn Y by the false twisting device 14 and run back along the yarn Y toward the first heater 13, where they are heat set. The twists may be imparted after the yarn Y is drawn at a predetermined draw ratio.

Then, the twists set at the first heater 13 are cooled by means of the first cooling plate 15 and the second cooling plate 16 as the yarn Y moves, and they enter into the false twisting device 14, and then, the yarn Y is detwisted as it leaves the false twisting device 14.

Figure 3:
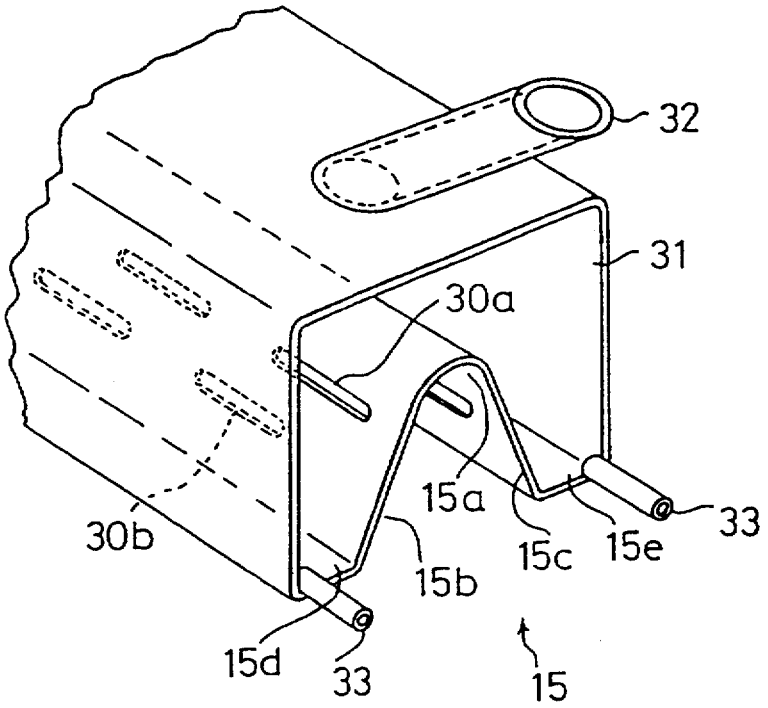
FIG. 3 is a perspective view of a first embodiment of the cooling plate according to the present invention.

An embodiment of the cooling plate 15 of the present invention is illustrated in FIG. 3. In the embodiment illustrated in FIG. 3, the cooling plate 15 is formed in a downwardly opening U-shape, and the yarn Y runs at the bottom portion 15*a*, which is illustrated at the top in FIG. 3, of the cooling plate 15, while the yarn Y is in contact with the bottom portion 15*a*.

Figure 4:
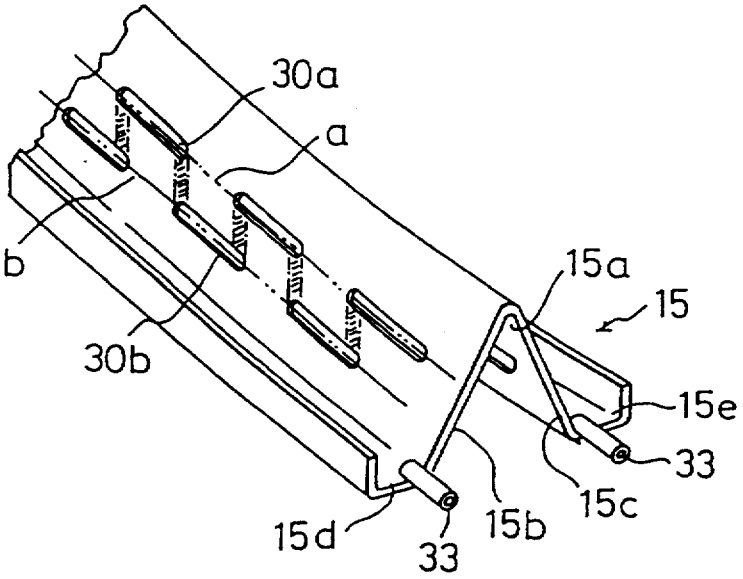
FIG. 4 is a perspective view of a second embodiment of the cooling plate according to the present invention wherein the illustration of some parts are omitted.

Another embodiment of the cooling plate 15 of the present invention is illustrated in FIG. 4. In order to simplify the illustration, a suction chamber 31 and a suction pipe 32 communicating with the suction chamber 31, which are illustrated in FIG. 3 and which will be explained later, are omitted from the embodiment of FIG. 4. The cooling plate 15 illustrated in FIG. 4 is formed in a downwardly opening V-shape. Similar to the embodiment illustrated in FIG. 3, the yarn Y runs at the bottom portion 15*a*, which is illustrated at the top in FIG. 4, of the cooling plate 15, while the yarn Y is in contact with the bottom portion 15*a*.

As clearly illustrated in FIGS. 3 and 4, the bottom portion 15*a*, where the yarn Y runs while it is in contact therewith, has no holes formed therein. Wall portions 15*b* and 15*c* are connected to the sides of the bottom portion 15*a* and extend outwardly from the bottom portion 15*a*. The wall portions 15*b* and 15*c* have elongated holes 30*a* and 30*b* formed therein and extending in a longitudinal direction of the cooling plate 15. The elongated holes 30*a* and 30*b* are formed along two imaginary lines a and b (see FIG. 4) which extend in the longitudinal direction and which are in parallel with each other. The ends of the elongated holes 30*a* and 30*b* are overlaid with each other in a direction along which the forces due to gravity act. The portions overlaid in a direction along which gravitational forces act are denoted by hatching in FIG. 4.

The lower ends of the wall portions 15*b* and 15*c* are bent outwardly, i.e., in a direction opposite to the bottom portion 15*a* to form bent portions 15*d* and 15*e*.

As illustrated in FIG. 3, the ends of the wall portions 15*b* and 15*c* forming the bent portions 15*d* and 15*e* are further bent to surround the outside of the yarn threading groove member and are connected to each other to form a suction chamber 31. The suction chamber 31 communicates with a suction means (not shown) through a suction pipe 32 as illustrated in FIG. 3. As described above, the suction chamber 31 and the pipe 32 communicating with the suction chamber 31 are omitted from FIG. 4.

Although the illustration of a side plate disposed downstream from the bent portion 15*d* and 15*e* is omitted from FIGS. 3 and 4, in actuality, the side plate is attached at the front end of FIGS. 3 and 4. The side plate has discharge outlets 33 mounted thereon for recovering finish gathered in the suction chamber 31, so that the finish is recovered at the lower side of the suction chamber 31, i.e., at the downstream side of the suction chamber 31 in the illustrated embodiment.

Figure 5:
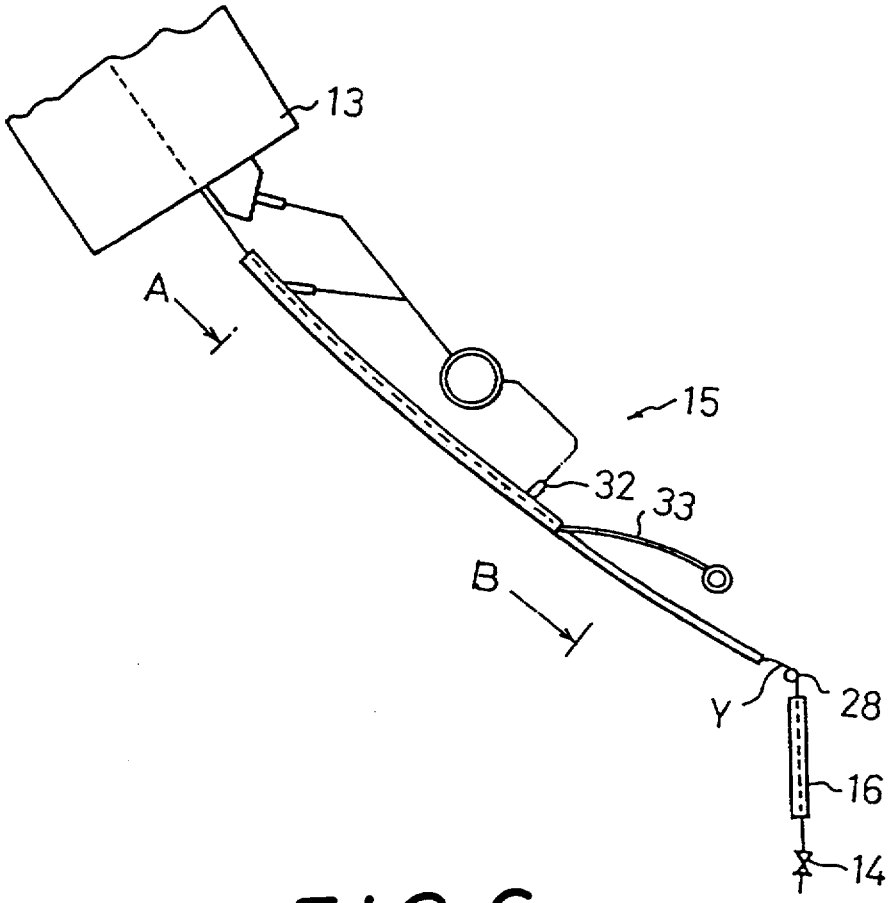
FIG. 5 is an enlarged elevation view of another cooling plate according to the present invention.
Figure 6:
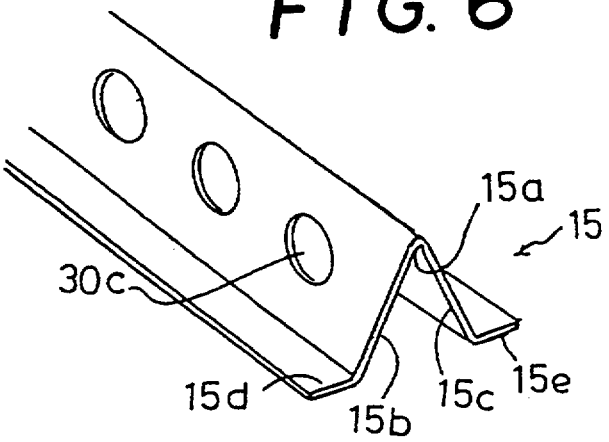
FIG. 6 is a perspective view of the downstream portion of the cooling plate illustrated in FIG. 5.

A further embodiment is illustrated in FIGS. 5 and 6. In this embodiment, the upstream side, i.e., the portion A near the first heater 13, of the cooling plate 15 has a construction similar to that of the embodiments illustrated in FIGS. 3 and 4. More specifically, the cooling plate 15 at this region A has a yarn threading groove member formed in a downwardly opening U-shape or V shape. The yarn threading member comprises a bottom portion 15*a*, where a yarn Y runs while it is in contact with the bottom portion 15*a*, and wall portions 15*b* and 15*c* connected to the bottom portion 15*a* and extending from the bottom portion 15*a*. The wall portions 15*b* and 15*c* have holes 30*a* and 30*b*, while the bottom portion 15*a* is provided with no holes. The holes 30*a* and 30*b* are elongated and extending in a longitudinal direction of the cooling plate 15, and a plurality of elongated holes 30*a* and 30*b* are formed along a plurality of imaginary lines which extend in the longitudinal direction and which are in parallel with each other. The ends of the elongated holes 30*a* and 30*b* are overlaid with each other in a direction along which forces due to gravity act. The lower ends of the wall portions 15*b* and 15*c* are bent outwardly, i.e., in a direction opposite to the bottom portion 15*a* to form bent portions 15*d* and 15*e*. The ends of the wall portions 15*b* and 15*c* forming the bent portion 15*d* and 15*e* are further bent to surround the outside of the yarn threading groove member and are connected to each other to form a suction chamber 31. The suction chamber 31 communicates with a suction means, and discharge outlets 33 communicates with the suction chamber 31.

Contrary to this, the downstream side of the cooling plate 15, i.e., the portion B away from the first heater 13, has such a construction as illustrated in FIG. 6. More specifically, the cooling plate 15 at this region has a yarn threading groove member formed in a downwardly opening U-shape or V shape. The yarn threading member comprises a bottom portion 15*a*, where a yarn Y runs while it is in contact with the bottom portion 15*a*, and wall portions 15*b* and 15*c* connected to the bottom portion 15*a* and extending from the bottom portion 15*a*. The wall portions 15*b* and 15*c* have a plurality of circular holes 30*c*, while the bottom portion 15*a* is provided with no holes. The lower ends of the wall portions 15*b* and 15*c* are slightly bent outwardly, i.e., in a direction opposite to the bottom portion 15*a*, to form bent portions 15*d* and 15*e* which are, different from the embodiments illustrated in FIGS. 3 and 4, in that the ends of the wall portions 15*b* and 15*c* are not connected to each other to form a suction chamber 31, and thus no suction chamber 31 is formed. The ends 15*d* and 15*e* of the wall portions 15*b* and 15*c* which are bent opposite to the bottom portion 15*a* are intended to reinforce the strength of the cooling plate 15.

At the upstream portion of the cooling plate 15 in the embodiment illustrated in FIGS. 5 and 6, the elongated holes are formed in the wall portions 15*b* and 15*c* and are oriented to a longitudinal direction of the cooling plate 15. At the same time, the suction chamber 31 is formed around the cooling plate 15. When the suction chamber 31 is actively being used, generation of liquid oil and its adhesion to the cooling plate can be prevented or decreased. In addition, due to the above-described construction, the scattered liquid oil is sufficiently removed at the upstream side of the cooling plate 15 and oily smoke, which may be generated by the rolling motion of the running yarn Y at the bottom portion 15*a* of the cooling plate 15 in the downstream side of the cooling plate 15, can be discharged to the outside environment through the plurality of holes 30*c* formed on the wall portions 15*b* and 15*c* by means of spontaneous convection of air.

According to the present invention, while no holes are formed at the bottom portion of the yarn threading groove member, only the wall portions of the yarn threading groove member of the cooling plate are provided with a plurality of holes. Accordingly, the length of the yarn contacting the bottom of the groove of the cooling plate is substantially the same as that contacting a cooling plate which has no holes. Thus, the contacting length (which determines the cooling temperature of the yarn or the restriction of the yarn vibration) is unchanged from that of a conventional apparatus. Generation and adhesion of oil drops also are remarkably decreased.

The present invention is especially advantageous when the first heater and the cooling plate are aligned substantially in a line, i.e., arranged so that the yarn passage scarcely has very small deflection therebetween, with a serious problem of oily smoke accompanying with a running yarn may easily be avoided.

We claim:

1. A texturing machine comprising:

a heater for heating a yarn;

a false twisting device for imparting twists to the yarn;

a cooling plate disposed between said heater and said false twisting device for cooling the yarn after the yarn has been heated by the heater and for inhibiting vibration of the yarn to allow the yarn to run in a stable manner;

said cooling plate being provided with a yarn threading groove member having a bottom portion which the yarn runs in contact with and wall portions connected to said bottom portion so as to form a concave downwardly directed opening; and wherein said wall portions of said yarn threading groove member each are provided with a plurality of holes, and said bottom portion of said yarn threading groove member is free of holes.

2. A machine according to claim 1, wherein said holes of said wall portions are elongated in a longitudinal direction of said cooling plate, and a plurality of elongated holes are disposed along a plurality of parallel lines directed in said longitudinal direction of said cooling plate, and ends of adjacent elongated holes disposed along said plurality of lines overlie each other in a direction along which gravitational forces act.

3. A machine according to claim 1, wherein ends of said wall portions opposite to said bottom portion are bent outwardly, respectively, and said ends are connected to each other rearwardly of said yarn threading groove member so as to form a suction chamber, and said suction chamber is in communication with a suction source.

4. A machine according to claim 3, wherein an outlet for discharging finish removed from said yarn is disposed at a lower side of said suction chamber.

5. A texturing machine or a draw texturing machine comprising a first heater for heating a yarn, a false twisting device for imparting twists to said yarn, and a cooling plate, disposed between said first heater and said false twisting device, for cooling the yarn which has been heated by said first heater and for inhibiting vibration of the yarn so as to allow the yarn to run in a stable manner;

said cooling plate being provided with a yarn threading groove member having a bottom portion which the yarn runs in contact with, and wall portions connected to said bottom portion to form a concave downwardly directed opening;

said wall portions of said yarn threading groove member each being provided with a plurality of holes;

said bottom portion of said yarn threading groove member being free of holes; and wherein said holes of said wall portions are elongated in a longitudinal direction of said cooling plate, and a plurality of said elongated holes are disposed along a plurality of substantially parallel lines directed along said longitudinal direction of said cooling plate, with ends of adjacent elongated holes overlying each other in a direction along which gravitational forces act.

* * * * *

UNITED STATES PATENT AND TRADEMARK OFFICE

CERTIFICATE OF CORRECTION

PATENT NO. : 5,372,004

DATED : December 13, 1994

INVENTOR(S) : Shigeru Yamamoto et al.

It is certified that error appears in the above-indentified patent and that said Letters Patent is hereby corrected as shown below:

Col. 5, line 37, "V shape" should be -- V-shape --; Col. 5, line 47, delete the comma; Col. 6, line 22, delete "with"; Col. 6, line 23, delete "with".

Signed and Sealed this

Twenty-fifth Day of July, 1995

Bruce Lehman

*Attest:*

BRUCE LEHMAN

*Attesting Officer*

*Commissioner of Patents and Trademarks*